United States Patent [19]

Bullock, III

[11] Patent Number: 4,625,876

[45] Date of Patent: Dec. 2, 1986

[54] CAP AND NECK STRUCTURE FOR A WIDE MOUTH JAR

[75] Inventor: Joseph J. Bullock, III, Atherton, Calif.

[73] Assignee: Cap Snap Co., Inc., San Jose, Calif.

[21] Appl. No.: 689,859

[22] Filed: Jan. 9, 1985

Related U.S. Application Data

[63] Continuation of Ser. No. 515,275, Jul. 19, 1983, abandoned, which is a continuation-in-part of Ser. No. 397,550, Jul. 12, 1982, Pat. No. 4,438,857.

[51] Int. Cl.[4] ..... B65D 41/48

[52] U.S. Cl. ..... 215/256

[58] Field of Search ..... 215/256, 254; 220/270, 220/274

[56] References Cited

U.S. PATENT DOCUMENTS

| | | | |
|---|---|---|---|
| 1,793,636 | 2/1931 | Robinson | 220/274 X |
| 3,885,695 | 5/1975 | Schaefer | 215/224 |
| 4,037,746 | 7/1977 | Ver Hage | 215/256 X |
| 4,127,209 | 11/1978 | Ritzenhoff | 215/256 X |
| 4,166,552 | 9/1979 | Faulstich | 215/320 X |
| 4,281,774 | 8/1981 | Mumford | 220/270 X |
| 4,438,857 | 3/1984 | Bullock | 215/256 |

FOREIGN PATENT DOCUMENTS

| | | | |
|---|---|---|---|
| 567070 | 11/1923 | France | 215/256 |
| 798284 | 7/1958 | United Kingdom | 215/256 |
| 1168550 | 10/1969 | United Kingdom | 215/254 |
| 1385034 | 2/1975 | United Kingdom | 215/224 |

*Primary Examiner*—Donald F. Norton
*Attorney, Agent, or Firm*—Julian Caplan

[57] ABSTRACT

A cap for a wide-mouth container has a short inner skirt and a longer outer skirt. The outer skirt has upper and lower internal locking beads which are preferably interrupted with gaps between bead sections. Above the lower locking bead is a circumferential score line. A portion of the outer skirt below the score line is cut away to form a pull tab extending parallel to the score line. The cap has a peripheral flange the underside of which slants downward-inward. The container neck is thin walled, having an internal top flange terminating in a first sealing surface which bears against the top of the inner skirt, a groove below the last-mentioned surface and a second sealing surface below the groove which also bears against the inner skirt. The neck also has upper and lower external beads each having shoulders on their lower edges under which the upper and lower internal locking beads of the cap seat. The neck curves outward in a lower shoulder immediately below the bottom edge of the skirt. The cap cannot be pried off with the fingers until the user grips the tab and tears off the portion of the outer skirt below the score line.

13 Claims, 11 Drawing Figures

CAP AND NECK STRUCTURE FOR A WIDE MOUTH JAR

This is a continuation of abandoned application Ser. No. 515,275 filed July 19, 1983 which is a continuation-in-part of application Ser. No. 397,550 filed July 12, 1982, and now U.S. Pat. No. 4,438,857.

This invention relates to a new and improved neck structure for a wide-mouthed jar such as the type used to package mayonnaise. The cap is preferably used with a plastic jar having a neck hereinafter described in detail. A feature of the present invention is the fact that the closure is tamper-proof in that, in order to obtain access to the contents of the jar, the bottom edge of the skirt of the cap must be torn off, giving evidence of tampering.

A further feature of the invention is the fact that it may be applied by pushing down on the cap so that beads on the interior of the outer skirt of the cap snap over mating beads on the exterior of the neck. The structure is such that the cap may be applied by standard capping machinery such as that used to apply plastic overcaps to metal cans for coffee and the like.

Thus, a further feature of the invention is the fact that, although the cap may readily be applied and may easily be removed, nevertheless a hermetic seal is provided by protuberances on the interior of cap neck engaging the wall on the inner skirt or plug of the cap.

Another feature of the cap structure is the fact that there is a stacking ring on the top disc of the cap, having a diameter such as to receive the inside of the bottom edge of the skirt of a superimposed cap. When caps are newly molded they tend to warp if not stored properly. The present invention facilitates such storing. Furthermore, nesting the caps, as provided by the stacking ring, reduces space requirements during transportation and also permits the caps to be fed into standard capping machinery magazines in nested fashion. The fact that there is no tab projecting below the bottom edge of the skirt is one of the features of the caps that facilitates nesting as heretofore described.

After the bottom of the skirt has been torn off, the cap may be removed by pulling it off the neck. To facilitate such operation a peripheral external flange is provided at the top of the cap. However, the underside of this flange is beveled, such as at a 45° angle, so that a dishonest patron cannot pull the cap off the neck before the skirt has been torn. The angle on the underside of the flange prevents the fingernails from being dug into the cap flange.

In a modification of the invention the flange has a flat underside which intersects the skirt wall at about a 90° angle. Hence the flange bends upward rather than providing a prying surface for tampering with the contents of the container without removing the skirt. Furthermore, a strong force applied to the flange tends to tear the flange, giving evidence of tampering.

The structure whereby the lower end of the skirt may be torn off is unique, enabling the consumer to grip a tab and, by pulling thereon, tear off the lower part of the skirt.

Reference is made to U.S. Pat. No. 4,166,552, which discloses the advantages of interrupted beads on the interior wall of the skirt of the cap, such beads being located above and below the tearline of the cap. Interruption of the beads makes it possible for the skirt to stretch when the cap is being installed on the bottle neck in a standard capping machine. Hence, the force required to seat the cap on the neck is lessened and this materially reduces the tendency of the neck of the bottle to be crushed or deformed during capping.

Another advantage of the use of interrupted beads on the cap is that is enables the container to be formed of blow-molded thin-wall plastic material because of the fact that the tendency to crush the cap is reduced. Thus, the present invention permits use of lighter weight and less expensive container construction.

A still further feature of the invention as disclosed herein is the provision of a thickening of the cap wall at the upper edge of the tear tab and extruding upward to merge with the lower locking bead. Hence likelihood of the tab tearing off before it has performed its function is eliminated.

Other objects of the present invention will become apparent upon reading the following specification and referring to the accompanying drawings in which similar characters of reference represent corresponding parts in each of the several views.

Figure 5:
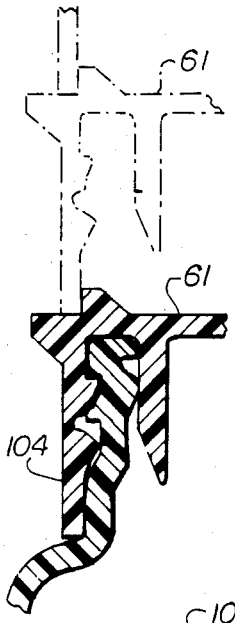
Figure 4:
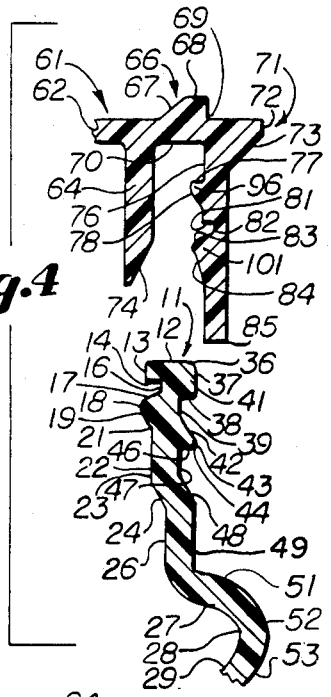
FIG. 4 is an exploded fragmentary sectional view of a portion of the cap and container neck prior to installation.

FIG. 5. is a view similar to FIG. 4 showing the cap and neck seated and locked.

Figure 1:
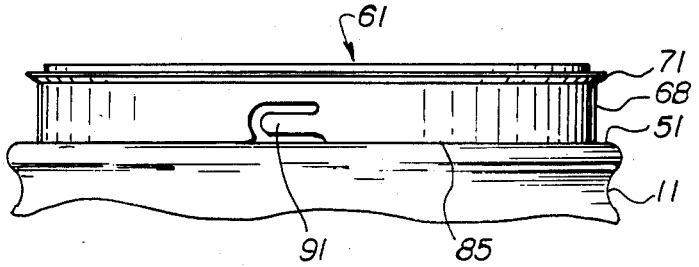
FIG. 1 is an elevational view of a cap intact on the upper portion of the neck of a wide-mouthed jar.
Figure 6:
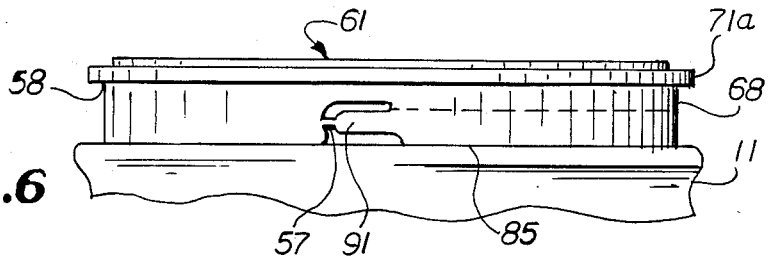

FIG. 6 is a view similar to FIG. 1 of a modification.

Figure 6A:
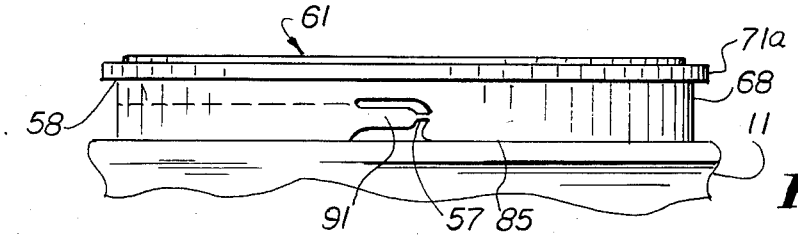

FIG. 6A is a view similar to FIG. 6 of a further modification in which the direction of tearing is reversed.

Figure 7:
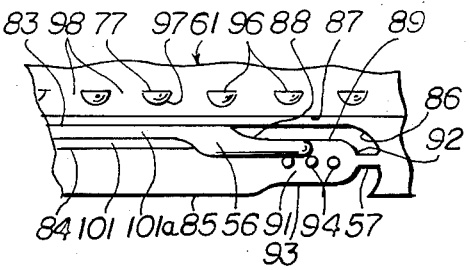
Figure 9:
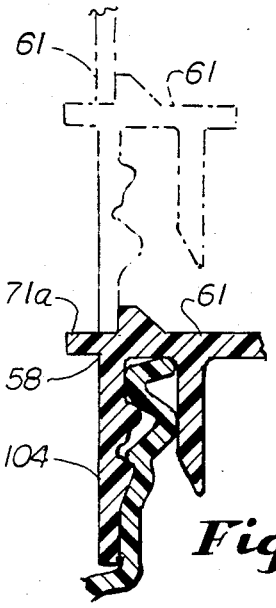
Figure 8:
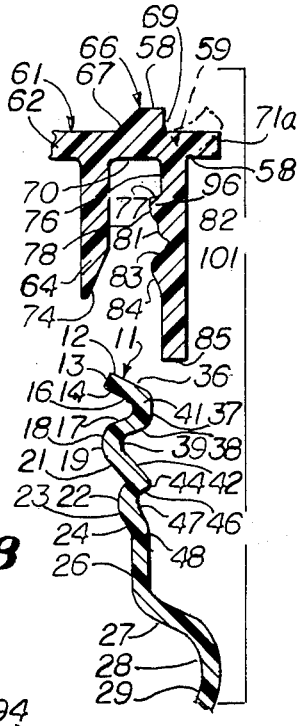

FIGS. 7 to 9 are views similar to FIGS. 2 to 5 respectively of the modification of FIG. 6.

Figure 3:
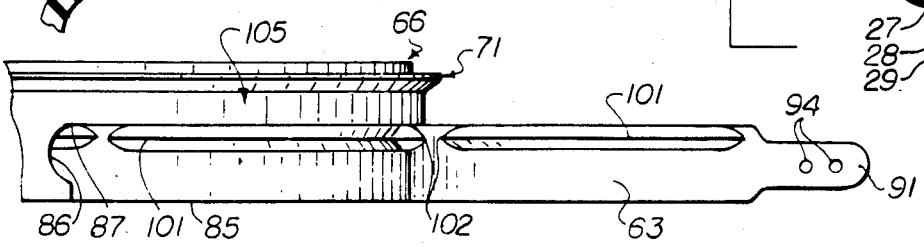
FIG. 3 is a fragmentary enlarged sectional view showing the tear strip partially torn off.
Figure 10:
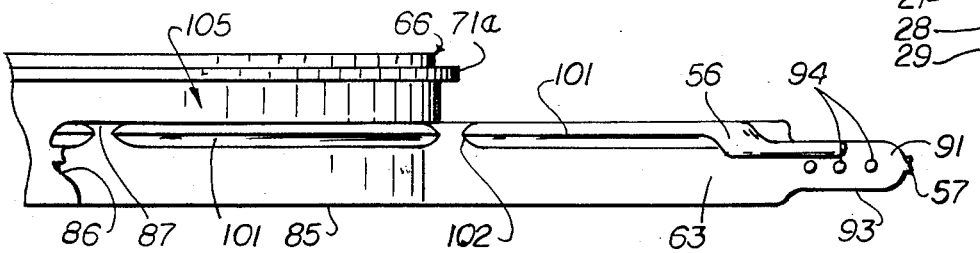

FIG. 10 is a view similar to FIG. 3 of a further modification.

The neck 11 of the container is preferably formed of blow-molded polyethylene or similar plastic material. Neck 11 has a top flange 12 which is inwardly-upwardly directed at an angle of about 20° as shown in FIG. 8 or flat as shown in FIG. 4. When cap 61 is applied, the slanted flange 12 of FIG. 8 is depressed, as shown in FIG. 9, providing tight sealing at its inner edge and also at its base. Considering first the interior of the neck, below top flange 12 is top internal vertical wall 13, which is one of the sealing surfaces making the closure airtight. Below wall 13, the neck extends outwardly substantially horizontally in a stretch 14 to a top internal groove 16. Thereupon the neck extends in a substantially horizontal inwardly extending ledge 17 to second internal vertical wall 18 which has a diameter substantially the same as that of wall 13 and constitutes the second sealing surface. Below wall 18 is first downward outwardly slanted wall 19 which terminates in second internal groove 21. The groove 21 merges with downward inward slanted wall 22 which merges with third internal vertical wall 23 of considerably greater diameter than the walls 13 and 18, which, in turn, merges with second outward downward slanted wall 24 and then fourth internal vertical wall 26. The cap extends outward below wall 26 for a purpose which thereinafter occurs. In order to maintain the thin-walled structure, the interior of the neck curves outwardly to a curved bead 28 which then merges with inwardly-downwardly curved surface 29. Below surface 29 the structure of the neck is a matter of choice.

Considering now the exterior of the neck 11, surface 12 has a curved outer corner 36 below which is top vertical wall 37, which terminates in top horizontal inward directed shoulder 38, thereby providing top neck bead 41. Below bead 41 is a top groove or second vertical wall 39. Below groove 39 is downward outward slanted surface 42, below which is a short vertical wall 44 to provide second external neck bead 43. The diameter of bead 43 is somewhat greater than that of bead 41. Below surface 44 is second horizontal inward directed shoulder 46 below which is fourth vertical wall 47 which is of slightly greater diameter than the top groove or wall 39. Second downward outward slanted wall 48 is below wall 47 and this terminates in fifth vertical wall 49. Below wall 49 is a horizontally extending shoulder 51 which projects outwardly and prevents a dishonest consumer from prying upward the lower edge of the cap skirt hereinafter discussed. Shoulder 51 terminates in a downward outward curved wall 52 which then terminates in a downward inward curved wall 53 substantially parallel to wall 29 on the interior of the neck. Below wall 53, the construction of the neck is a matter of choice.

MODIFICATION OF FIGS. 1-5

Cap 61 has a top disc 62 from the bottom of which extend outer skirt 63 and inner skirt 64. Inner skirt 63 is of lesser length than outer skirt 63 and has substantially vertical inner and outer walls, the inner wall terminating in a downward inward slanted bevel 74 which facilitates seating the cap 61 on the neck 11. As is best shown in Fig. 5, the surfaces 13 and 18 of the neck 11 seal against the outer surface of the interior skirt, or plug, 64 and make the closure airtight. At the same time, the underside 70 of the disc 62 between the two skirts seals on the top edge 12 of neck 11. On the top of disc 62 substantially directly above the underside surface 70 is a stacking ring 66 which projects upwardly a short distance. Ring 66 has an upward outward slanted surface 67, a horizontal top edge 68 and a substantially vertical downward outer edge 69. As best shown in FIG. 4 the lower edge of the skirt of a superimposed cap nests immediately outside the surface 69 of the stacking ring 66, so that a series of caps may be superimposed.

After the skirt of the cap has been torn off (as hereinafter explained) the upper portion of the cap functions as a reclosure cap for repeated snapping onto and off of the neck 11. To facilitate such removal of the reclosure cap, a peripheral flange 71 is provided on the disc 62 extending beyond the outer substantially vertical surface of the outer skirt 63. However, in order to prevent dishonest persons from removing the cap before the lower portion of the skirt has been torn off, flange 71 is formed with a short vertical wall 72 which terminates in a downward inward slanted wall 73 at about a 45° angle. This prevents the dishonest person from digging the fingernails under the flange 71 to pry the cap off the neck before the skirt 63 is torn.

Turning now to the configuration of the inside of the skirt 63, below surface 70 is an inner vertical wall 73 of approximately the length of bead 41 of neck 11. Wall 76 terminates in horizontal inward extending shoulder 77. Shoulder 77 terminates in a downward outward slanted surface 78 which completes the definition of the internal cap bead 96 which locks under the bead 41 of the neck and seats in groove 39. As hereinafter described, the bead 96 is not continuous, but is interrupted. Surface 78 terminates in a short vertical wall 78 below which is a vertical wall 79. The interior of the skirt 13 below wall 79 extends in a horizontally outward surface 81 terminating in groove 82. Below groove 82, the wall has a downward inward slanted surface 83 and thence a downward outward slanted surface 84, the surfaces 83 and 84 defining the interrupted second cap bead 101 which locks under neck bead 43. Below surface 83, the cap is downward outward slanted in surface 84 terminating in the bottom edge 85 of the cap.

Directing attention now to FIGS. 1 and 5, it will be seen that the neck beads 41 and 43 snap into the areas immediately above the internal cap beads 96 and 101 respectively. The lower edge 85 of the outer cap skirt fits tightly upon the surface 51 of the neck, preventing the fingernails from gripping below the edge 85 to pull the cap off.

Figure 2:
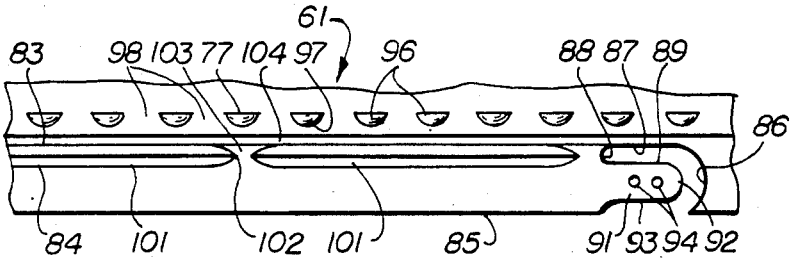
FIG. 2 is a schematic view of the interior of a portion of the outer cap skirt developed in a plane to show the interruptions of the upper and lower locking beads.

Directing attention now to FIG. 2, the interrupted upper bead sections 96 have horizontal top edges 77 and arcuate bottom edges 97. Between the bead segments 96 are gaps 98.

The lower bead sections 101 have substantially horizontal top surfaces 83 and substantially horizontal bottom surfaces 84. The ends 102 of the bead sections 101 taper and there are gaps 103 between the sections. Bead sections 96 are preferably small and are spaced apart in gaps 98 approximately one and one-half times the length of each section 96. The gaps 103 between the lower bead sections 101 are, on the contrary, short. Bead sections 101 are approximately five and one-half times the length of bead sections 96.

Between the bead sectios 96 and 101 is a horizontal groove 104. In fact, the groove 104 is in close proximity to the top edge 83 of groove sections 101. It is along the groove 104 that the lower portion of the skirt is torn, thereby removing the bead sections 101.

At one location of the cap skirt 63, there is an upwardly curved edge 86 extending out from the bottom edge 85 which terminates in a horizontal edge 87 having a rounded terminus 88. A horizontal edge 89 extends back parallel to edge 87 to define tear-off tab 91. Tab 91 has a curved end 92 in proximity to surface 86. The underside of tab 91 is relieved as indicated in undercut 83. To facilitate gripping the tab 91, tips 94 may be formed on the inside so that the fingers engage the same. As best shown in FIG. 1, the user, in order to open the closure, grips the tab 91 and pulls to the right or, as viewed in top plan, counter-clockwise. This causes the outer skirt 63 to be torn along the groove 104, thereby removing the portion of the cap which contains the beads 101.

After the skirt has been torn, the remaining portion of the cap 61 functions as a reclosure cap 105. Cap 105 may be removed from the neck 11 by pulling upward on the flange 71, so that the bead sections 96 snap out from under the bead 41 and its shoulder 38. The reclosure cap 105 may be reapplied merely by pushing downward and may be removed and reapplied repeatedly as required.

MODIFICATION OF FIGS. 6-10

The container neck and many of the details of the modification of FIGS. 6, 7, 8 and 9 resemble those of FIGS. 1-5 and the same reference numerals are used throughout. A thickening 56 of the tear tab 91 extends along the upper edge of the tab and then upwardly to merge with the lower bead **101*a* which is shown in FIG. 7 as being continuous rather than interrupted, as shown in FIG. 2. In FIG. 10 thickening 56 is shown merging with the nearest bead section 101** of the interrupted lower bead, similar to that of FIG. 3.

If one pulls upward or downward on tab 91 of the modification of FIGS. 1–5, instead of circumferentially around the cap, the tab may break off before it has fulfilled its function. The thickening 56 lessens the likelihood of the tab breaking off.

As shown in FIG. 7, a thin, frangible link 57 may join the end of the tab 91 to cap adjacent curved edge 86. Link 57 indicates efforts to pry off the cap without tearing the skirt and also prevents unintentional premature pulling of tab 91.

FIG. 6A is similar to FIG. 6 but shows the tear tab extending in the opposite direction. It has been found that some patrons find it easier to remove the lower skirt if the tab extends in one direction than the other.

Flange 71*a* shown in FIGS. 6–10 is rectangular in cross-section and the flat underside thereof intersects the outer wall of the outer skirt 63 at about a 90° angle, providing a sharp corner 58. If one attempts to pry flange 71*a* upward, it flexes as shown in FIG. 8, thus frustrating any attempt to remove the cap 61 without tearing off the skirt. Further forcing flange 71*a* upward causes the cap to fracture along lines 59, giving evidence of tampering.

What is claimed:

1. A cap of the type having a central top disc, a thin-walled substantially cylindrical outer skirt of substantially uniform thickness depending from said disc, an upper internal circumferential bead on said outer skirt, a lower internal circumferantial bead on said outer skirt below said upper bead, a circumferential score line in said outer skirt above said lower bead, a portion of said outer skirt below said score line being cut away to form a pull tab extending in a direction parallel to said score line, whereby upon pulling said tab circumferentially, said outer skirt severs along said score line, said lower bead being removed as said tab is pulled, said portion of said outer skirt cut away comprising a straight section parallel to and immediately below said score line, the improvement which comprises a thickening along the upper edge of said tab, said thickening extending upward and merging with said lower bead.

2. A cap according to claim 1 which further comprises at least one gripping tip formed on said tab.

3. A cap according to claim 1 which further comprises a short inner skirt depending from said top disc spaced inward from said outer skirt.

4. In combination, a cap according to claim 3 and a container for said cap having a neck and having an inturned top flange, said flange terminating in an internal smooth first sealing surface bearing against the top of said inner skirt, a groove below said first sealing surface, an internal, smooth second vertical sealing surface below said groove, said second sealing surface bearing against said inner skirt, a first external neck bead, a second external neck bead spaced down from said first external neck bead, said external neck beads each having shoulders on their lower edges, said upper and lower internal beads of said cap locking under the shoulders of said first and second external beads of said neck, respectively.

5. The combination of claim 4 in which at least one of said internal beads of said cap is interrupted in a series of gaps spaced around the circumference of said outer skirt forming bead sections.

6. In combination, a cap according to claim 3 and a container for said cap having a neck and having an inturned top flange with a upward-inward slanted lip, said flange terminating in an internal smooth first sealing surface bearing against the top of said inner skirt, a groove below said first sealing surface, an internal, smooth second vertical sealing surface below said groove, said second surface bearing against said inner skirt, a first internal neck bead, a second external neck bead spaced down from said first external neck bead, said external neck beads each having shoulders on their lower edges, said upper and lower internal beads of said cap locking under the shoulders of said first and second external beads of said neck, rerespectively.

7. A cap according to claim 1 in which said top disc has a peripheral flange extending beyond said outer skirt.

8. A cap according to claim 1 in which said top disc has a peripheral flange extending beyond said outer skirt, said flange being rectangular in cross section and joining the outer wall of said outer skirt in a sharp corner.

9. A cap according to claim 1 which further comprises a stacking ring above said top disc having a vertical outer edge of a diameter about that of the inside diameter of the bottom of said outer skirt.

10. A cap according to claim 1 which further comprises a frangible horizontally-extending link joining the outer end of said tab and the adjacent cut away edge of said skirt.

11. A cap according to claim 1 in which said lower bead is formed with bead sections with gaps spaced between said bead sections and in which said thickening along the upper edge of said tab extends upward and merging with the nearest of said bead sections of said lower bead.

12. A cap according to claim 1 in which said portion of said skirt cut away further comprises an arcuate section of about 180° extending from said straight section down to the lower edge of the outer skirt, and the lower edge of said tab being cut away at a level above the lower edge of said skirt immediately thereabove, said arcuate section being interrupted by a horizontally-extending link joining an end of said tab and the adjacent cut-away edge of said skirt.

13. A cap of the type having a central top disc, a thin-walled substantially cylindrical outer skirt of substantially uniform thickness depending from said disc, an upper internal circumferential bead on said outer skirt, a lower internal circumferential bead on said outer skirt below said upper bead, a circumferential scoreline in said outer skirt above said lower bead, a portion of said outer skirt below said scoreline being cut away to form a pull tab extending in a direction parallel to said score line, whereby upon pulling said tab circumferentially, said outer skirt severs along said score line, said lower bead being removed as said tab is pulled, said portion of said outer skirt cut away comprising a straight section parallel to and immediately below said score line, the improvement which comprises said tab being formed by a hoizontal upper cut-away portion of said skirt immediately below said score line, an arcuate section of about 180° and a lower horizontal cut away portion above the level of the lower edge of said skirt immediately thereabove, said arcuate section being interrupted by a frangible horizontally-extending link joining the outer end of said tab and the adjacent cut-away edge of said skirt.

* * * * *